United States Patent [19]

Bout

[11] Patent Number: 4,532,580

[45] Date of Patent: Jul. 30, 1985

[54] SIGNALLING LIGHT

[75] Inventor: Willem J. F. Bout, Hilversum, Netherlands

[73] Assignee: U.S. Philips Corporation, New York, N.Y.

[21] Appl. No.: 593,181

[22] Filed: Mar. 26, 1984

Related U.S. Application Data

[63] Continuation of Ser. No. 324,884, Nov. 25, 1981, abandoned.

[30] Foreign Application Priority Data

Dec. 22, 1980 [NL] Netherlands ..... 8006948

[51] Int. Cl.[3] ..... F21V 7/00

[52] U.S. Cl. ..... 362/306; 362/353; 362/435

[58] Field of Search ..... 362/296, 306, 157, 353, 362/435, 440, 444, 448, 457

[56] References Cited

U.S. PATENT DOCUMENTS

| | | | |
|---|---|---|---|
| 1,447,378 | 3/1923 | Fornaca | 362/306 |
| 1,575,548 | 3/1926 | Cuno | 362/306 |
| 1,696,965 | 1/1929 | Neungr | 362/296 |
| 1,812,476 | 6/1931 | Godley | 362/306 |

FOREIGN PATENT DOCUMENTS

| | | | |
|---|---|---|---|
| 269163 | 1/1914 | Fed. Rep. of Germany . | |
| 457854 | 3/1928 | Fed. Rep. of Germany . | |
| 104775 | 5/1963 | Netherlands | 362/306 |
| 1422112 | 1/1976 | United Kingdom | 362/306 |

*Primary Examiner*—Magdalen Y. C. Moy
*Attorney, Agent, or Firm*—Robert S. Smith

[57] ABSTRACT

A signalling light according to the invention has a concave reflector with a substantially cylindrical lamp holder for an electric lamp. The position of the lamp holder can be adjusted from inside the reflector. The lamp holder is connected to the reflector so as to be rotatable about its axis. Means which can be manipulated from inside the reflector fix the lamp holder in any adjusted position.

The construction of the signalling light makes it possible to position an asymmetric light source in the reflector in such manner that an optimum light beam is obtained.

2 Claims, 4 Drawing Figures

SIGNALLING LIGHT

This is a continuation of application Ser. No. 324,884, filed Nov. 25, 1981, now abandoned.

BACKGROUND OF THE INVENTION

The invention relates to a signalling light having a concave reflector which at its apex has a substantially cylindrical lamp holder, for an electric lamp, arranged substantially coaxially with the axis of the reflector. Such a signalling light is known from German Patent Specification 424,062.

The signalling light may be used in traffic control, for example, for indicating warning signs, velocity limits, halt signs and the like. As the light source an incandescent lamp is frequently used having an Edison or a Swan lamp cap and having a transparent lamp envelope for optimum luminous efficiency. The filament of the lamp is usually stretched in the lamp envelope in an arc and disposed substantially in a plane transverse to the axis of the lamp cap. Since the filament is not stretched as a closed or nearly closed curve so as to avoid flashover between its ends, the light beam which emanates from the reflector is not symmetrical: more light is radiated in some directions than in other directions. In signalling lights, however, minimum requirements are imposed upon the light fluxes in various directions with respect to the axis of the reflector.

In lamps having an Edison lamp cap, the final rotational position of the filament when the lamp is screwed into a lamp holder is uncertain. This position depends on the length of the lamp cap including the base contact, on the turning moment with which the lamp is screwed in the lamp cap, and on the position of the filament relative to the screw thread of the lamp cap. Thus, even if the position of the filament relative to the screw thread of the lamp cap were the same for every lamp, the position of the filament in the reflector would nevertheless still be uncertain.

On many manufacturing machines it is impossible to connect the lamp cap (Edison or Swan) to the lamp envelope while positioned sufficiently accurately with respect to the filament. As a result of this in signalling lights the minimum requirements as regards the light flux in various directions are not always satisfied unless lamps are used of a larger power than would have been necessary in the case of accurate positioning of the filament.

It is an object of the invention to provide a signalling light which permits assembling therein an incandescent lamp having its filament accurately positioned rotationally with respect to a reference plane through the axis of the reflector.

In a signalling light of the kind mentioned in the opening paragraph this object is achieved according to the invention in that the reflector has an edge near its apex and the lamp holder has a flange, the edge and the flange being kept pressed against each other by a spring which constitutes the above-mentioned retaining means.

SUMMARY OF THE INVENTION

The construction of the signalling light according to the invention permits rotation of the lamp holder with an electric lamp incorporated therein about its axis in such manner that the filament of the lamp assumes a previously determined position which is optimum for the radiated light beam. When the edge and the flange are manually separated by a force opposite to the spring force, the lamp holder can easily be rotated while the spring afterwards ensures the retention of the adjusted position. The position of the filament of the lamp is in most of the cases very readily observable since, as already noted, a lamp having a transparent lamp envelope is usually used. Since an optimum positioning of the electric lamp is possible, a lamp having a minimum power may be used.

Preferably, both the edge and the flange are substantially conical. This has the advantage that particularly good retention of the lamp holder in the reflector is precisely obtained while in addition the lamp holder is centered with respect to the reflector.

BRIEF DESCRIPTION OF THE DRAWINGS

Embodiments of the signalling light according to the invention are shown in the drawing. In the drawing

DESCRIPTION OF THE PREFERRED EMBODIMENT

Figure 1:
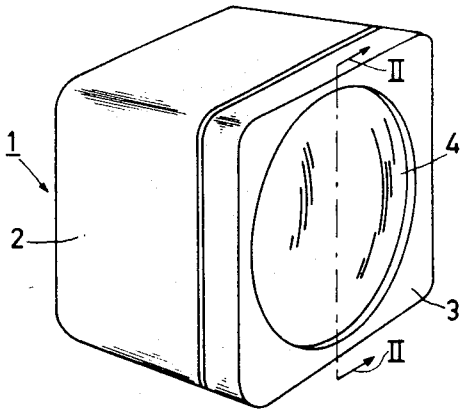
FIG. 1 is a perspective view of a signalling light.

Of the signalling light 1 shown in FIG. 1 only the housing 2 and the door 3 with the cover glass 4 are visible. If the signalling light is to display a symbol, a template is present behind the cover glass 4.

Figure 2:
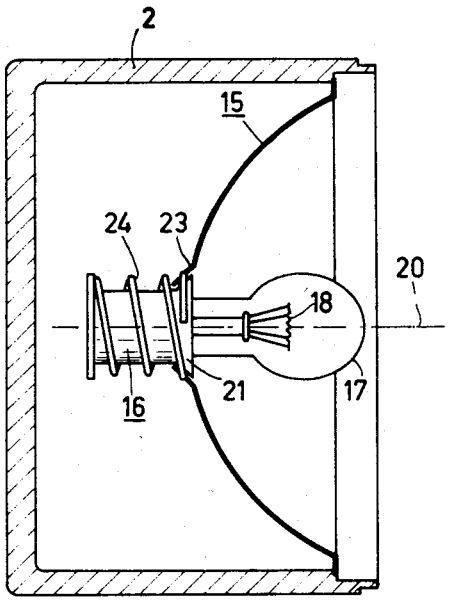
FIG. 2 is a sectional view through the signalling light 2 of FIG. 1 taken on the line II—II.
Figure 2A:
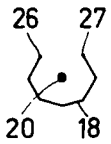
FIG. 2*a* is a front elevation of the filament of FIG. 2.

In FIG. 2 the housing 2 supports a paraboloidal reflector 15 that has near its center or top a generally conical edge 23. The substantially cylindrical lamp holder 16, whose axis 20 coincides with the axis of the paraboloid 15 has a generally conical flange 21. A helical spring 24 surrounds lamp holder 16 and keeps the edge 23 and the flange 21 pressed against each other. A lamp having a transparent lamp envelope 17 and a filament 18 stretched in an arc disposed in a plane oriented transversely to the axis 20 (see FIG. 2*a*) is present in the lamp holder 6. The arc formed by the filament 18 is open on its upper side with the ends 26 and 27 being spaced apart so as to prevent flashover.

The helical spring 24 ensures fixation of the position of the lamp holder 16 relative to the reflector 15 and makes it possible to screw the incandescent lamp 17 in the lamp holder 16 without it being necessary to hold the lamp holder 16. After the incandescent lamp 17, has been screwed into the lamp holder 16 until electrical contact has been established and the lamp holder 16 exerts a sufficient clamping force on the lamp 17, then the lamp 17 together with the lamp holder 16 is rotated about the axis 20 so as to provide the correct angular position of the filament 18. This rotation is facilitated by drawing the lamp 17 together with the lamp holder 16 to the right in the Figure so that the flange 21 is temporarily separated from the edge 23. When the correct position of the filament 18 has been reached, the spring 24 is allowed to draw the lamp 17 and the lamp holder 16 to the left in the Figure. The spring 24 ensures fixation of the adjusted position and centers the lamp holder 16 in the reflector 15 due to the conical shape of the edge 23 and the flange 21. Therefore, the lamp holder 16, with a lamp 17 incorporated therein, which can be operated from inside the reflector, is connected in the reflector 15 so as to be rotatable about its axis 20 and fixable in an adjusted position by means of the spring 24.

Figure 3:
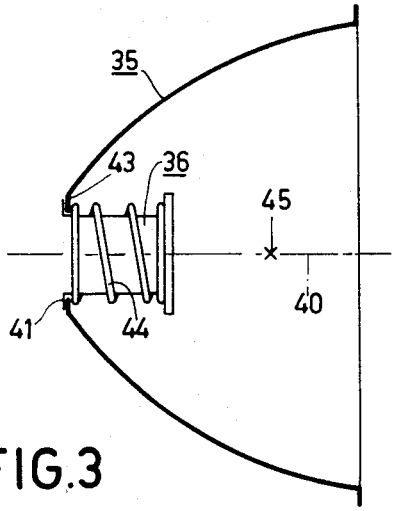
FIG. 3 is a detail of an analogous sectional view of another embodiment.

The reflector 35 in FIG. 3 is considerably deeper than that shown in FIG. 2. In order to be able to mount the filament of a lamp near the focus 45 of the reflector 35, the lamp holder 36 projects into the reflector 35. Near its top the reflector 35 has a flat edge 43 which is pressed against a flange 41 of the lamp holder 36 by a helical spring 44. By exerting a pressure force on a lamp placed in the lamp holder 36 the flange 41 is separated from the edge 43 and the lamp holder 36 operable from the reflector 35 proves to be connected to said reflector so as to be rotatable. The helical spring 44 ensures fixation of the lamp holder 36 in an adjusted position in the reflector.

What is claimed is

1. A signalling light which comprises:

a concave reflector having an axis and an apex, a substantially cylindrical lamp holder disposed substantially at said apex for holding an associated electric lamp in substantially coaxial relation with said axis, means for mounting said lamp holder to said reflector which permits rotational movement therebetween to vary the relative angular positions by up to 360 degrees, said means comprising said reflector having near the apex thereof an opening defined by a periphery, said periphery being rotationally symmetrical, said lamp holder having a peripheral flange which is rotationally symmetrical, said periphery and said peripheral flange being dimensioned and configured for mutual engagement, and spring biasing means positioning said periphery and said peripheral flange in engagement, said periphery and said peripheral flange slidingly engaging to allow relative rotational movement.

2. A signalling light as claimed in claim 1, wherein said periphery and said peripheral flange are each conical sections.

* * * * *